US005177529A

United States Patent [19]

Schroll et al.

[11] Patent Number: 5,177,529

[45] Date of Patent: Jan. 5, 1993

[54] MACHINE WITH REMOVABLE UNIT HAVING TWO ELEMENT ELECTRICAL CONNECTION

[75] Inventors: Ross E. Schroll, East Rochester; Jeffrey J. Folkins, Rochester, both of N.Y.

[73] Assignee: Xerox Corporation, Stamford, Conn.

[21] Appl. No.: 276,835

[22] Filed: Nov. 25, 1988

[51] Int. Cl.[5] ..... G03G 15/00

[52] U.S. Cl. ..... 355/200; 310/251; 310/249; 310/253; 355/210

[58] Field of Search ..... 355/200, 210, 219; 310/248, 249, 251, 253; 361/225

[56] References Cited

U.S. PATENT DOCUMENTS

| | | | |
|---|---|---|---|
| 3,324,445 | 6/1967 | Miller | 339/61 |
| 3,668,451 | 6/1972 | McNab | 310/248 |
| 3,757,164 | 9/1973 | Binkowski | 317/2 R |
| 4,074,924 | 2/1978 | Lebecque | 339/20 |
| 4,314,172 | 2/1982 | Diepers | 310/248 |
| 4,336,565 | 6/1982 | Murray et al. | 361/225 |
| 4,337,407 | 6/1982 | Hummert | 310/249 |
| 4,349,760 | 9/1982 | Diepers | 310/248 |
| 4,358,699 | 11/1982 | Wilsdorf | 310/251 |
| 4,361,775 | 11/1982 | Diepers et al. | 310/248 |
| 4,408,814 | 10/1983 | Takashi et al. | 339/59 M |
| 4,553,191 | 11/1985 | Franks, Jr. et al. | 361/212 |
| 4,561,763 | 12/1985 | Basch | 355/200 |
| 4,607,936 | 8/1986 | Miyakawa et al. | 355/210 |
| 4,641,949 | 2/1987 | Wallace et al. | 355/35 H |
| 4,706,320 | 11/1987 | Swift | 15/1.5 R |
| 4,714,337 | 12/1987 | Nishino et al. | 355/200 |
| 4,741,942 | 5/1988 | Swift | 428/82 |
| 4,761,709 | 8/1988 | Ewing et al. | 361/225 |
| 4,774,389 | 9/1988 | Spivey | 200/164 R |

FOREIGN PATENT DOCUMENTS 1500642 12/1966 France .

*Primary Examiner*—Richard L. Moses

[57] ABSTRACT

An electrostatographic printing machine comprising a main frame and at least one unit insertable into and removable from said main frame for cooperative association therewith in producing prints, said main frame and said removable unit having at least one electrical connection to conduct electric current therebetween comprising two electrical contacting elements, one on each of said main frame and said removable unit a first element comprising a plurality of resiliently flexible conductive fibers arranged in a brush-like configuration and the second element comprising a substantially continuous conductive contact surface for electrical contact with said brush each of said contacting elements being connected to an electrical component.

43 Claims, 5 Drawing Sheets

MACHINE WITH REMOVABLE UNIT HAVING TWO ELEMENT ELECTRICAL CONNECTION

CROSS REFERENCE TO RELATED APPLICATIONS

Attention is directed to copending application Ser. No. 07/272,280 entitled "Pultruded Electrical Device" in the name of Joseph A. Swift et al. filed Nov. 17, 1988. Attention is also directed to copending application Ser. No. 188,984 entitled "Electrically Insulating Polymer Matrix With Conductive Path Formed in situ" in the name of Epstein et al. filed May 2, 1988 now U.S. Pat. No. 4,841,099. Both of the above applications are commonly assigned to the assignee of the present invention.

BACKGROUND OF THE INVENTION

The present invention relates generally to an electrical connection for use in a machine having at least one removable unit to operate properly. More particularly, it relates to an electrical connection having two elements, one on each of the main frame of the machine and one on the removable unit, one element comprising a plurality of resiliently flexible conductive fibers in a brush-like configuration the other element being a continuous conductive contact surface for the fibers. In a preferred embodiment, the machine is an electrostatographic printing machine.

In electrostatographic reproducing apparatus commonly used today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, a light beam may be modulated and used to selectively discharge portions of the charged photoconductive surface to record the desired information thereon. Typically, such a system employs a laser beam. Subsequently, the electrostatic latent image on the photoconductive insulating surface is made visible by developing the image with developer powder referred to in the art as toner. Most development systems employ developer which comprises both charged carrier particles and charged toner particles which triboelectrically adhere to the carrier particles. During development, the toner particles are attracted from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure.

In order to minimize maintenance costs by permitting the operator to replace warn out or exhausted processing units in electrostatographic apparatus, it has been suggested to incorporate one or more processing units of the apparatus in disposable or removable cartridges or units. In this way the operator can readily remove each cartridge when its operational life has been exhausted and insert a new cartridge. In addition, it also provides the advantage of being able to use less expensive functional features such as the photoreceptor drum in a conventional copier. Typically, these processing cartridges include an imaging member such as a rotatable drum or a endless belt together with one or more of a charge corotron, a developing device and cleaning device. For further description of such machine architecture attention is directed, for example to U.S. Pat. No. 3,985,436 to Tanaka et al., U.S. Pat. No. 4,462,677 to Onoda, U.S. Pat. No. 4,470,689 to Moramora et al., and U.S. Pat. No. 4,460,267, U.S. Pat. No. 4,556,308 to Hoppner et al..

In these commercial applications, it is of course necessary to distribute power, high voltage and/or logic signals between the main frame of the machine and the removable processing unit or cartridge. Traditionally, this has taken the form of utilizing conventional wires and wiring harnesses in each machine to distribute power and logic signals between the main frame of the machine and the removable processing unit. For example, conventional plug and socket arrangements have been used which can be either manually connected or joined automatically on insertion of the unit into the main frame. This automatic joining requires precision positioning and alignment of the unit on insertion with very low tolerance for error. Typically locating members such as pins, rails, etc. are used to insure proper positioning which adds to the manufacturing cost of the machine. In addition, conventional wires and wiring harnesses are flexible and therefore, do not lend themselves to automated assembly such as with the use of robots further leading to increased manufacturing costs. While certain other electrical contacts have been proposed, they suffer certain deficiencies. For example, the use of two conventional metal plate contacts such as two spring biased metal tabs one on each of the main frame and the removable unit in addition to requiring the precision positioning and alignment discussed above can be rendered unreliable after only a short period of use in the hostile machine environment by having the contacting surfaces contaminated by dirt, toner or other debris. Furthermore, such metal contacts tend to oxidize forming an insulating layer on the contact surface thereby further degrading the reliability and performance of the contact.

PRIOR ART

U.S. Pat. No. 4,553,191 to Franks et al. describes a static eliminator device for use in a machine which comprises a plurality of resiliently flexible thin fibers having an electrical resistivity of from about $2\times10^3$ ohms centimeters to about $1\times10^6$ ohm centimeters which are preferably made of a partially carbonized polyacrylonitrile fiber and which may be used in machines having at least one electrical component suspectible to being electrically shorted by contact with conductive fibrous material.

U.S. Pat. Nos. 4,706,320 and 4,741,942 to Swift describe electrostatic charging and cleaning brushes which are made from a spirally wound conductive pile fabric strip forming a spiral seam between adjacent landings of the fabric strip, the fiber filled density of said fabric strip edge being at least double the fiber filled density in the center portion of the fabric strip.

U.S. Pat. No. 4,761,709 to Ewing et al. describes a contact brush charging device having a plurality of resiliently flexible thin fibers having a resistivity of from about $10^2$ ohm-cm to about $10^6$ ohm-cm which are substantially resistivity stable to changes in relative humidity temperature.

U.S. Pat. No. 4,641,949 to Wallace et al. describes a reproducing machine with a paper position sensor which comprises oppositely disposed conductive fiber brushes and/or brush like elements for detecting the presence or absence of paper at various locations in a xerographic machine. The brushes are made from polyacrylonitrile fibers which can be fabricated with relatively low values of resistance. Each individual conductive fiber acts as a separate electrical path through which the external circuit is completed. The passage of paper through the nip of the fiber to fiber electrical contact opens the circuit which is easily detected. Arrays incorporating multiple sensors may be fabricated by positioning a first array of discrete conductive fiber brushes opposite a second array of discrete conductive fiber brushes.

U.S. Pat. No. 4,358,699 to Wilsdorf describes a versatile electrical fiber brush and a method of making it wherein the electrical properties of the brush are controlled by the fiber wires by making extremely large number of fiber wires of very small diameters to contact the object at the working surface of the brush. Mechanical tunneling is expected to become the predominant mechanism of current conduction, yield extremely good brush performance while at the same time brush wear is very low.

SUMMARY OF THE INVENTION

The present invention is directed to a machine comprising a main frame and at least one unit which is insertable into and removable from the main frame for cooperative association therewith in performing a function, the main frame and removable unit having at least one electrical connection to conduct electric current there between which is comprised of two electrical contacting elements, one on each of the main frame and a removable unit, the first element comprising a plurality of resiliently flexible conductive fibers arranged in a brush like configuration and the second element comprising a substantially continuous conductive contact surface for electrical contact with the brush.

In a further aspect of the present invention the machine is an electrostatographic printing machine wherein the removable unit has at least one processing component which is used in cooperative association with the components on the main frame to produce prints.

In a further aspect of the present invention the contacting elements on the main frame and the removable unit are each connected to an electrical component.

In a further aspect of the present invention, the area of the contact surface is substantially greater than the cross sectional area of the brush.

In a further aspect of the present invention the fibers are oriented and extend in a uniform direction so that the distal ends of the fibers are in electrical contact with the contact surface.

In a further aspect of the present invention the contact surface is a planar metal surface.

In a further aspect of the present invention the contact surface is a pultruded composite member comprising a plurality of small diameter conductive fibers in a polymer matrix, the plurality of fibers being oriented in the matrix in a direction substantially parallel to the axial direction of the member and being continuous from one end of the member to the other to provide a plurality of potential electrical contacts at each of said members.

In a further aspect of the present invention, the fibers have a diameter of from about 5 to about 50 micrometers and an electrical resistivity of from about $10^{-5}$ to about $10^{6}$ ohm-cm..

DESCRIPTION OF THE PREFERRED EMBODIMENT

The invention will now be described with reference to a preferred embodiment of a removable processing cartridge in an electrostatographic printing apparatus employing same.

Figure 1:
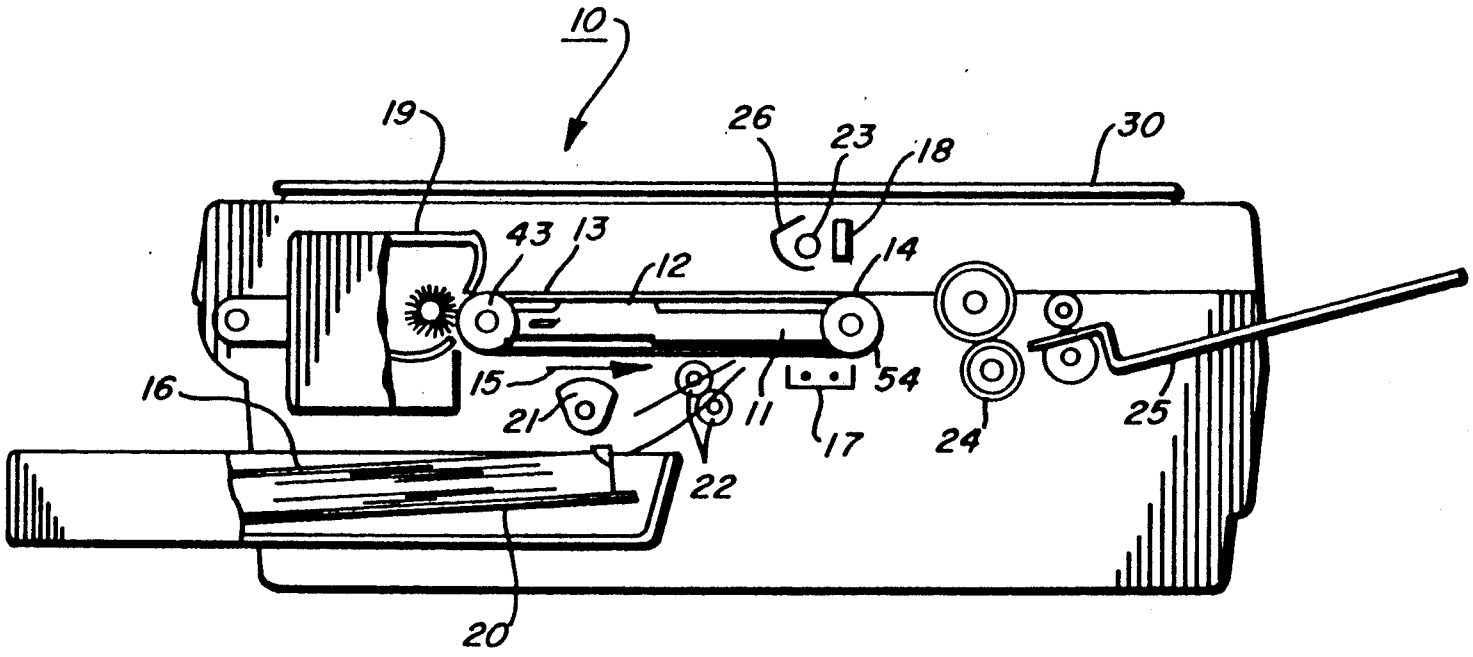
FIG. 1 is a schematic representation in cross section of an electrostatographic printing machine with a removable processing cartridge and an electrical connection therefore according to the present invention.

Referring now to FIG. 1 there is shown by way of example an automatic xerographic machine 10 which includes the removable processing cartridge and cartridge mount of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in application to the particular embodiment or embodiments shown herein.

The illustrated automatic reproducing machine 10 is adapted to operate in two-cycle fashion in that the photoreceptor belt is charged, exposed and the resulting electrostatic latent image developed on the first cycle of the belt while the developed toner image on the belt is transferred to a copy sheet as the belt begins its second revolution through the processing stations. Thereafter in the second cycle of operation the belt is cleaned of residual toner by the developer station in preparation for producing the next copy. With this two-cycle geometry a combined charging/transfer unit and a combined developer/cleaning unit are used.

Figure 2:
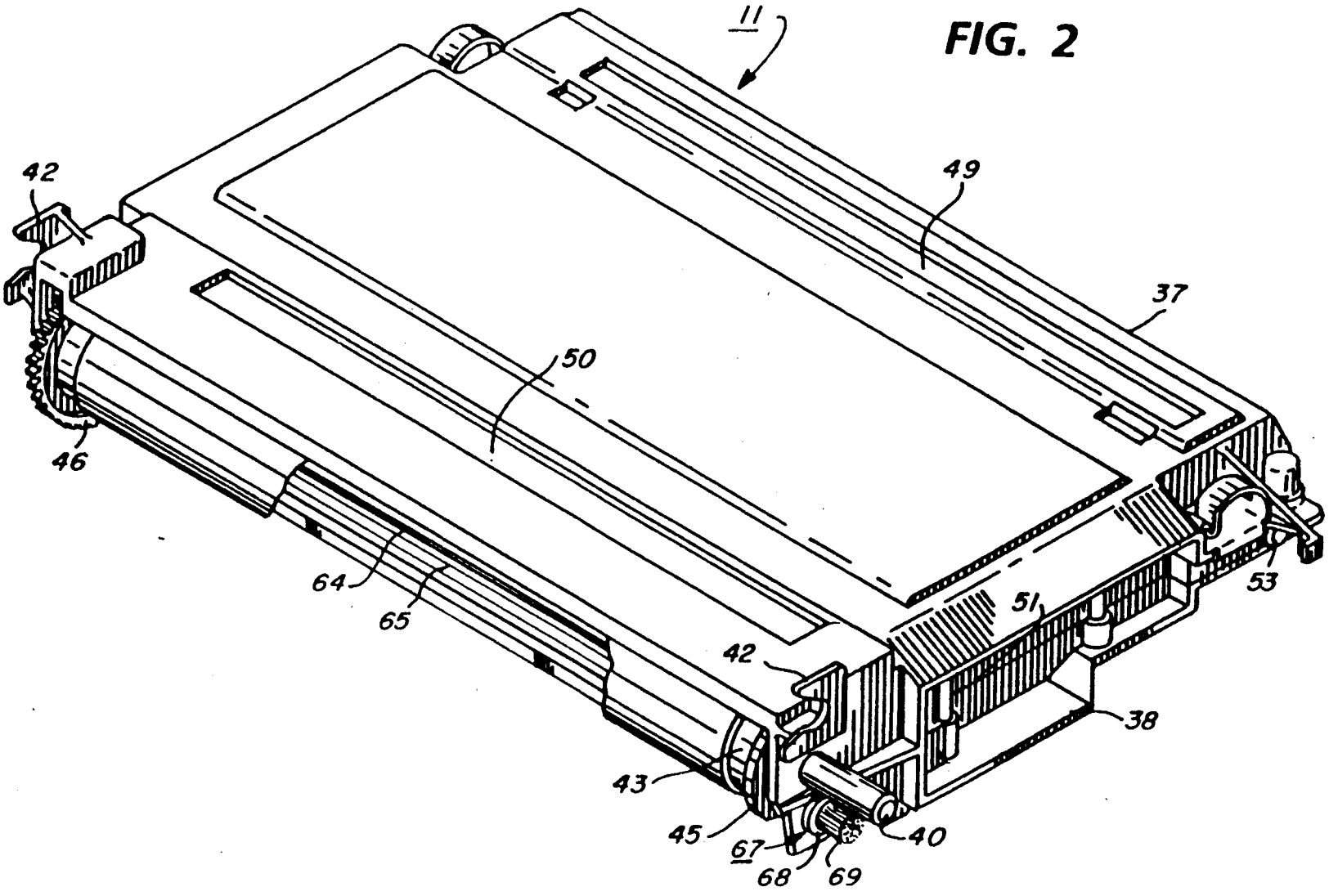
FIG. 2 is an isometric view showing the removable processing cartridge with one element of the electrical connection according to the present invention.

The reproducing machine 10, illustrated in FIGS. 1 and 2 employs a removable processing cartridge 11, image recording belt-like member 12, the outer periphery of which is coated with a suitable photoconductive material 13. The belt 12 is suitably mounted for revolution within the cartridge about driven transport roll 43 and idler roll 54 and travels in the direction indicated by arrow 15 to bring the image-bearing surface 13 thereon past a plurality of xerographic processing stations. Suitable drive means (not shown) are provided to power machine components whereby a faithful reproduction of the original input scene information is recorded upon a sheet of final support material 16 such as paper or the like.

Initially, the belt 12 moves the photoconductive surface 13 through a charging/transfer station 17 wherein the first cycle, the belt is charged with an electrostatic charge uniformly placed over the photoconductive surface 13 in known manner preparatory to imaging. Thereafter, the belt 12 is driven to exposure station 14 where the charged photoconductive surface 13 is exposed to a light image of the original input scene information whereby the charge is selectively dissipated in the light exposed regions to record the original input scene in the form of an electrostatic latent image. The exposure station preferably comprises a bundle of image transmitting fiber lenses 18, produced under the tradename of "Selfoc" by Nippon sheet Glass Company Limited, together with an illuminating lamp 23 and reflector 26. After exposure the belt 12 transports the electrostatic latent image recorded on the photoconductive surface 13 to development/cleaning station 19 wherein a developer is applied to the photoconductive surface of the drum 12 rendering the latent image visible. Typically, a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator segmented feed roll 21 feeds individual sheets therefrom to the registration pinch rolls 22. The sheet is then forwarded to the charging/transfer station 17 in proper registration with the image on the belt and the developed image on the photoconductive surface 13 is brought into contact with the sheet 16 of final support material within the charging/transfer station 17 and the toner image is transferred from the photoconductive surface 13 to the contacting side of the final support sheet 16. Following transfer of the image the final support material which may be paper, plastic, etc., as desired is separated from the belt by the beam strength of the support material 16 and the support material 16 and the sheet with the toner image thereon is advanced to a suitable fuser such as roll fuser 24 which fixes the transferred powder image thereto. After the fusing process the sheet 16 is advanced to a suitable output device such as tray 25.

Although a preponderance of toner powder is transferred to the final support material 16, invariably some residual toner remains on the photoconductive surface 13 after the transfer of the toner powder image of the final support material. The residual toner particles remaining on the photoconductive surface 13 after the transfer operation are removed form the belt 12 as it moves in its second cycle through the developing/-cleaning station 19 where the toner particles may be mechanically cleaned from the photoconductive surface 13 by the same magnetic brush as used in developing the electrostatic latent image.

Normally, when the copier is operated in a conventional mode, the original document to be reproduced is placed image side down upon a horizontal transparent viewing platen 30 which transports the original past an optical arrangement here illustrated as Selfoc lens 18. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

The removable processing cartridge is illustrated in greater detail in isometric FIG. 2. It will be understood that such a processing cartridge may be inserted and withdrawn in the machine in the manner indicated in U.S. Pat. No. 4,556,308 to Hoppner et al. from the top or alternatively in the manner indicated in U.S. Pat. No. 4,655,578 to Kurtz et al. from the front. The cartridge assembly 11 comprises an upper cartridge housing 37 and a lower cartridge housing 38, which are fastened together through suitable housing fasterners such as screws (not shown). The mounting arrangement for the cartridge comprises mounting pins 40 on each side of one end of the cartridge assembly here illustrated as the stationary drive shaft for the belt transport roll 43. Both ends of the belt transport roll have end caps 45 positioned thereon with one end being connected through drive gear 46 to the main machine drive to provide positive drive to the belt. Positioned adjacent to the mounting pins 40 on both sides of the cartridge are mounting hinge slots 42. At the other end of the cartridge assembly is a idler roll shaft 53 about which the idler roll 54 is mounted, once again with end caps 45 at each end thereof. The photoreceptor belt 12 is transported around transport roll 43 and idler roll 54 through the various processing stations in the two-cycle reproducing apparatus. In addition to the removable processing cartridge being equipped with the photoreceptor belt it may also have additional electrostatographic processing units and functions contained therein. Exposure slot 49 permits exposure of the photoreceptor belt from the optical system of the reproducing apparatus. Furthermore erase slot 50 permits the exposure of the photoreceptor during the second cycle of imaging and just prior to cleaning of residual toner image by an erase lamp. In addition, the removable processing cartridge may contain a corotron such as precharge corotron 64 contained within corotron shield 65. The precharge corotron 64 is electrically connected to a brush 67 comprised of a plurality of resiliently flexible conductive fibers 69 which mate with a fixed contact surface on the main machine frame when the cartridge is inserted in position.

Figure 3:
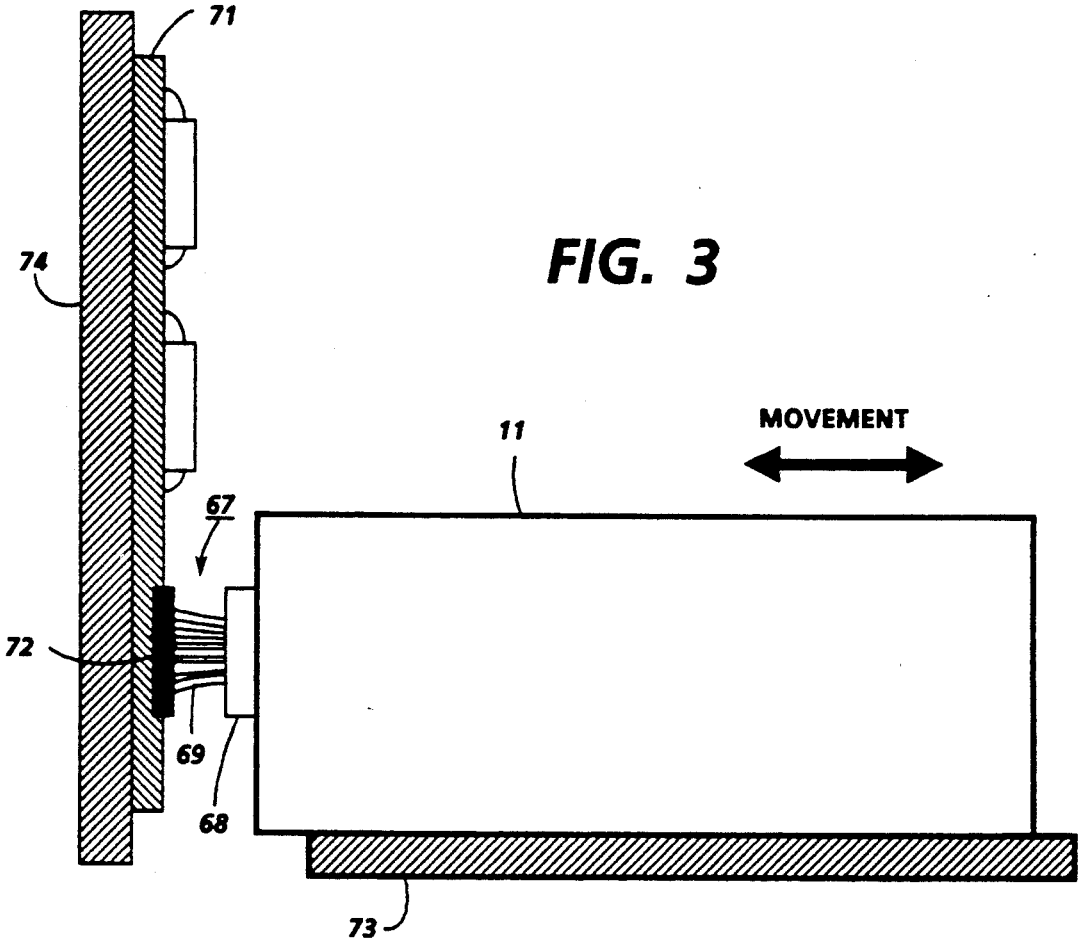
FIG. 3 is an enlarged sectional view showing the electrical connection according to the present invention.

Turning now to FIG. 3, the electrical connection between the main frame and the removable unit is illustrated in greater detail. A portion of the main frame 74 has fastened to it an electrical circuit board 71 having a conductive landing pad 72. The removable cartridge 11 has at one end a plurality of fibers 69 arranged in a brush-like configuration 67 held firmly together by terminal ring 68. The brush 67 is fixed to the removable unit 11 and as indicated in FIG. 2 may be connected directly to, for example, a precharge corotron. The removable cartridge is inserted into the main frame by sliding it on slide rails 73 into position. Upon being moved into position, the plurality of individual fibers 69 contact the conductive landing pad 72 with the fibers being slightly deflected or bent and maintaining contact with the landing pad to establish the electrical connection. Alternatively, the landing pad may be a conductive pattern on the surface of insulative structure. In the embodiment illustrated in FIG. 3, the electrical connection between the removable unit and the main frame is made in a direction which is generally oriented parallel to the direction of insertion (see the arrow) of the removable unit.

Figure 4:
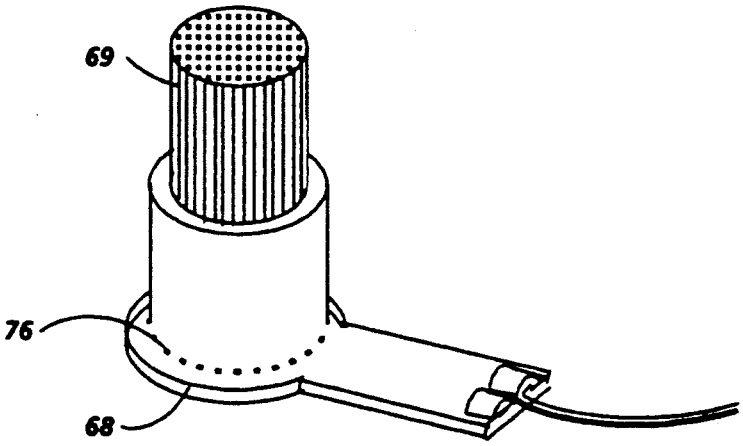
FIG. 4 is an enlarged view of the brush contact element illustrating its termination to a wire.

Turning now to FIG. 4, an example of a construction wherein the conductive brush contact is terminated in a wire is illustrated. The conductive fibers 69 are adhesively secured together by means of a conductive adhesive such as an epoxy 76 at one end thereof which is connected to a terminal 68 which in turn is connected to wire 77. Preferably in this embodiment, the wire 77 is connected to the terminal in a traditional crimping fashion thereby providing a reliable low cost interconnection to the conductive fiber bundle. The conductive adhesive in the terminal may provide rigidity to the conductive brush contacting element.

Figure 5:
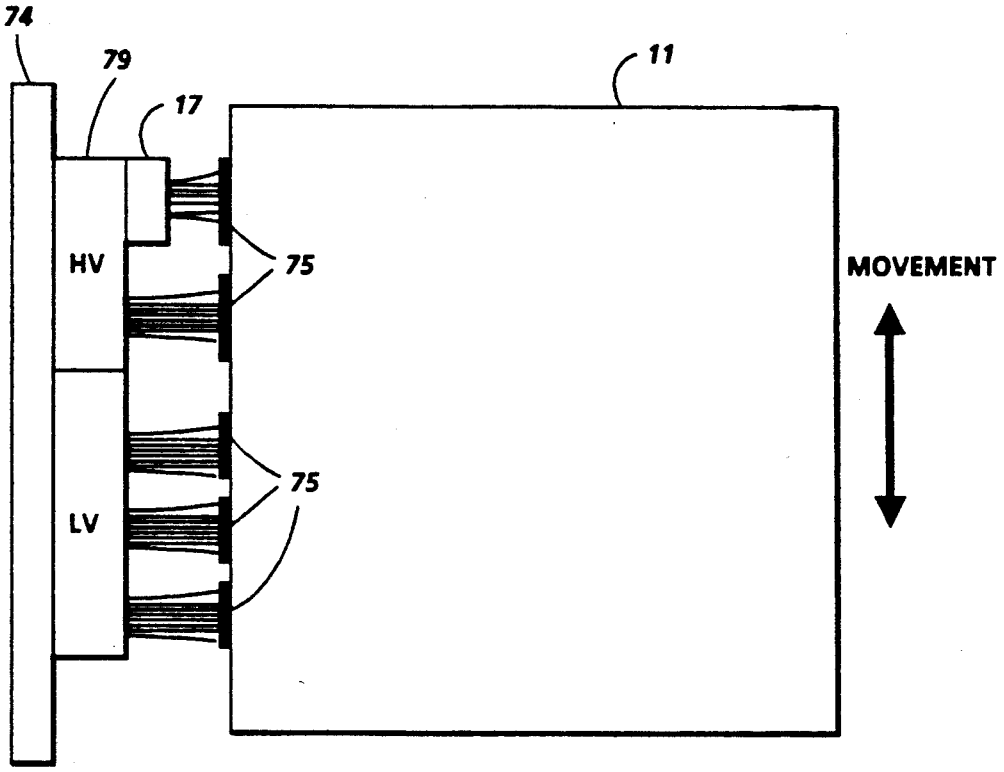
FIG. 5 is a plan view of a plurality of both high voltage and low voltage connections between the removable unit and the main frame of the machine which are arranged in the direction perpendicular to the direction of cartridge insertion.

FIG. 5 illustrates an alternative embodiment wherein the electrical connection is made between contacting elements on the removable unit and the main frame in the direction substantially perpendicular to the direction of insertion (see the arrow) of the removable unit into the main frame. In addition, in FIG. 5, there are illustrated two high voltage electrical connections and three low voltage electrical connections it being noted that with respect to all the connections that the landing pads 75 are present on the removable unit whereas the conductive brush element of the electrical connection is present on a mounting block 79 on a portion of the main frame 74. Alternatively, and as illustrated in FIG. 3, the brushes could be mounted on the removable unit and the landing pads mounted on the main frame it being noted that the selection of mounting location is independent of high or low voltage. Furthermore, the direction of insertion in FIGS. 3 and 5 may be reversed.

The first element in the electrical connection is a brush-like member comprising a plurality of resiliently flexible conductive fibers. Any suitable fiber may be used for this contacting element. Typically, the conductive fibers have a DC volume resistivity of from about $10^{-5}$ to about $10^{6}$ ohm-cm and preferably from about $10^{-5}$ to about $10^{-3}$ ohm-cm. as there are a variety of materials having resistivities in this range which are commercially available. The more conductive portions of the range of resistivity find particular use in current carrying applications while the more resistive portions find particular use in transmitting signal level potential and other low current carrying applications. In addition, the individual conductive fibers will have a diameter generally on the order of from about 5 to about 50 micrometers and preferably from about 7 to 10 micrometers which provides a very high degree of redundancy in a small axial area. The length of the brush fibers is significant to the extent that they must be sufficiently long to make a reliable contact. By the term resiliently flexible, it is intended to define fibers which may be substantially deformed by contact with another surface and when that contact is terminated will substantially return to their original configuration. Typically, the fibers are supplied in the form of continuous multifilament yarn which may have as few as 40 filaments per yarn bundle or as many as 160,000 filaments per yarn bundle. For example, stainless steel yarns are typically produced containing 60 to 90 filaments where each filament can range from about 5 to about 15 or more micrometers in diameter. Carbon fibers on the other hand are typically supplied in yarn form having 1,000, 6,000, 12,000 and up to 160,000 filaments where each filament can range from about 7 to 10 micrometers in diameter. Other conducting fibers are available ranging in diameter up to 50 micrometers and can be obtained either as monofilaments or monofilament yarns having the desired number of filaments. Typically, the fibers are assembled in a brush like configuration to provide from about $5\times10^{4}$ to about $2.5\times10^{5}$ contacts per square centimeter. While the end of the brush may be squarely shaped; it will be understood that the brush end may be otherwise shaped as by being tapered or diagonally beveled for example. Typical fibers include stainless steel, carbon, carbon graphite, mixtures of stainless steel and carbon. A particularly preferred fiber that may be used are those fibers that are obtained from the controlled heat treatment processing to yield partial carbonization of the polyacrylonitrile (PAN) precursor fibers. It has been found for such fibers that by carefully controlling the temperature of carbonization within certain limits that precise electrical resistivities for the carbonized carbon fibers may be obtained. The polyacrylonitrile precursor fibers are commercially produced by the Stackpole Company, Celion Carbon Fibers, Inc., a division of BASF and others in yarn bundles of 1,000 to 160,000 filaments. The yarn bundles are partially cabonized in a two-stage process involving stabilizing the PAN fibers at temperatures of the order of 300° C. in an oxygen atmosphere to produce preox-stabilized PAN fibers followed by carbonization at elevated temperatures in an inert (nitrogen) atmosphere. The D.C. electrical resistivity of the resulting fibers is controlled by the selection of the temperature of carbonization. For example, carbon fibers having an electrical resistivity of from about $10^{2}$ to about $10^{6}$ ohm-cm are obtained if the carbonization temperature is controlled in the range of from about 500° C. to 750° C. For further reference to the processes that may be employed in making these carbonized fibers attention is directed to the above-referenced U.S. Pat. No. 4,761,709 to Ewing et al. and the literature sources cited therein at column 8. As illustrated in FIG. 4, the fibers may be assembled in a brush-like configuration with the use of a conductive adhesive in a rigid terminal holder. Typical conductive adhesives include epoxies such as eccobond silver filled epoxy, and silver print by G. C. Electronics. Alternatively, the first element in the electrical connection may be one end of a pultruded member as described hereinafter which has had the polymer matrix removed at one end to expose the individual fibers. For further details of such pultruded member reference is directed to the above-referenced application application No. 07/272,280 the disclosure of which is specifically and totally incorporated by reference herein.

The continuous conductive contact surface may be made from any suitable conductive material. Typically, the contact surface or landing pad is planar although it may take a concave, convex or other curved form in a particular application. Typically, the contact surface, has an overall area substantially greater than the cross sectional area of the brush in the first element of the electrical connection. This larger contact area is provided to insure completing the necessary electrical contact between the two elements without the necessity of precision positioning and alignment of the removable unit relative to the main frame. Alternatively, a large area brush may be used with a relatively small area lending pad to provide the desired position insensitivity in those applications where the fibers can not track metal components.

In selecting the relative resistivities of the brush and landing pad contacts there are only three possibilities; the resistivity of the brush may be greater than, equal to or less than the resistivity of the landing pad contact. As a practical matter, it is desirable to select the area of the landing pad and the resistivity of the material used to make up the landing pad such that the resultant resistance does not limit effectiveness of the contacting pair. In other words, for a unit thickness of landing pad contact the product of resistivity and cross-sectional area should produce a resistance less than or equal to the resistance of the brush contact having equivalent unit length and selected resistivity and cross-sectional area. We say this as a practical matter in that it is easier to select the geometry and resistivity of landing pad contact. However, certain applications may prefer the reverse which is selecting the geometry and resistivity of the brush element and permitting the resistance of the landing pad contact to limit the circuit resistance. Typcially the landing pad or contact surface has a resistivity of from about $10^{-6}$ to about $10^{10}$ ohms cm. Typical materials useful as the landing pad or contact surface or metalized plastic sheets include metals and conductive plastic sheets. A particularly preferred landing pad contact is a pultruded member comprising a plurality of small diameter conductive fibers in a polymer matrix with the plurality of fibers being oriented in the matrix in a direction substantially parallel to the axial direction of the member and being continuous from one end of the member to the other to provide a plurality of potential electrical contacts at each end of said member.

The pultruded element may be made from any suitable fiber. Typically, the conductive fibers will have a DC volume resistivity of from about $1\times10^{-5}$ to about $1\times10^{10}$ ohm-cm and preferably from about $1\times10^{-3}$ to about 10 ohm-cm to minimize resistance losses. However, higher resistivity materials may be used if the input level of the electronic device is sufficiently high. In addition, the individual conductive fibers are generally circular in cross section and have a diameter generally in the order of from about 4 to about 50 micrometers and preferably from about 7 to 9 micrometers which provides a very high degree of redundancy in a small axial area. The fibers are typically flexible and compatible with the polymer systems. Typical fibers include carbon, carbon/graphite, metallized or metal coated carbon fibers and metal coated glass fibers.

A particularly preferred fiber that may be used are those fibers that are obtained from the controlled heat treatment processing to yield partial carbonization of the polyacrylonitrile (PAN) precursor fibers. It has been found for such fibers that by carefully controlling the temperature of carbonization within certain limits that precise electrical resistivities for the carbonized carbon fibers may be obtained. The polyacrylonitrile precursor fibers are commercially produced by the Stackpole Company, Celion Carbon Fibers, Inc., division of BASF and others in yarn handles of 1,000 to 160,000 filaments. The yarn bundles are partially carbonized in a two-stage process involving stabilizing the PAN fibers at temperatures of the order of 300° C. in an oxygen atmosphere to produce preox-stabilized PAN fibers followed by carbonization at elevated temperatures in an inert (nitrogen) atmosphere. The D.C. electrical resistivity of the resulting fibers is controlled by the selection of the temperature of carbonization. For example, carbon fibers having an electrical resistivity of from about $10^2$ to about $10^6$ ohm-cm are obtained if the carbonization temperature is controlled in the range of from about 500° C. to 750° C. For further reference to the processes that may be employed in making these carbonized fibers attention is directed the above-referenced U.S. Pat. No. 4,761,709 to Ewing et al. and the literature sources cited therein at column 8. Typically these carbon fibers have a modulus of from about 30 million to 60 million psi or 205–411 GPa which is higher than most steels thereby enabling a very strong pultruded composite member. The high temperature conversion of the polyacrylonitrile fibers results in a fiber which is about 99.99% elemental carbon which is inert and which when used in a high energy application upon oxidation will yield only carbon monoxide or carbon dioxide which are gases that do not contaminate the fiber end contacts.

One of the advantages of using conductive carbon fibers is that they have a negative coefficient of thermal conductivity so that as the individual fibers become hotter, they become more conductive. This provides an advantage over metal fibers since the metal fibers operate in just the opposite manner and therefore tend to burn out by self destructing. In a particular application, where very high conductivity of the order of $10^5$ (ohm cm)$^{-1}$ is desired, the fibers may be metallized or plated with a metal such as nickel, silver or gold. The carbon fibers have the a further advantage in that their surfaces are inherently rough thereby providing better adhesion to the polymer matrix.

Any suitable polymer matrix may be employed. The polymer may be insulating or conducting. If optimum electrical connection is desired at the edges of the pultrusion a conducting polymer may be used. Conversely, if insulating properties are desired at the edges of the pultrusion an insulating polymer may be used.

Typically, the polymer is selected from the group of structural thermoplastic and thermosetting resins. Polyester, epoxy and vinyl esters are in general, suitable materials with the polyester being preferred due to its short cure time and relative chemical inertness. If an elastomeric matrix is desired, a silicone, fluorosilicone or polyurethane elastomer may provide the polymer matrix. Typical specific materials include Hetron 613, Arpol 7030 and 7362 available from Oshland Oil, Inc., Dion Iso 6315 available from Koppers Company, Inc. and Silmar S-7956 available from Vestron Corporation. For additional information on suitable resins attention is directed to Chapter 4 of the above-referenced Handbook by Meyer. Other materials may be added to the polymer bath to provide their properties such as corrosion or flame resistance as desired. In addition, the polymer bath may contain fillers such as calcium carbonate, alumina, silica or pigments to provide a certain color. Further additives to alter the viscosity, surface tension or to assist in bonding the pultrusion to the other materials may be added. Naturally, if the fiber has sizing applied to it, a compatible polymer should be selected. For example, if an epoxy resin is being used, it would be appropriate to add an epoxy sizing to the fiber to promote adhesion.

The fiber loading in the polymer matrix depends upon the conductivity desired and the cross sectional area. Typically, the resins have a specific gravity of from about 1.1 to about 1.5 while the fibers have a specific gravity of from about 1.7 to about 2.5. In providing the levels of conductivity heretofore mentioned, typically the pultruded composite member is more than 50% by weight fiber and preferably more than 80 or even 90% fiber, the higher fiber loadings providing more fibers for contacts and lower bulk resistivity. To increase the conductivity of the matrix additional conductive fiber may be added.

The pultruded composite members may be prepared according to the pultrusion technique as described, for example, by Meyer in "Handbook of Pultrusion Technology". In general, this will involve the steps of pre-rinsing the continuous multi-filament strand of conductive carbon fibers in a pre-rinse bath followed pulling the continuous strand through the molten or liquid polymer followed by pulling it through a heated die which may be at the curing temperature of the resin into a oven dryer if such is necessary to a cut-off or take-up position. For further and more complete details of the process attention is directed to Meyer. While the desired final shape of the pultruded composite member may be that provided by the die, alternatively it is capable of being machined with conventional carbide tools. Typically, holes, slots, ridges, grooves, convex or concave contact areas or screw threads may be formed in the pultruded composite member by conventional machining techniques.

Desirably, the landing pad or conductive contact surface can be molded, shaped or into a part or bracket in either the main frame or the removable unit. For example, providing an etched conductive pattern in a printing wiring board or conductive pattern on plastic may be very effective in providing the electrical contact at an absolute minimum of expense.

The electrical connection described herein may be used in both low voltage and high voltage applications. The electrical connection according to the present invention is capable of enabling at least one operation in cooperative association between the main frame and the removable unit whether it be something such as a low voltage logic circuitry or a connection to a high voltage power supply. By the term electrical component as used herein, it is intended to define any component that may be used in the transmission of electrical current such as wires, circuit, circuit boards, switches, power supplies, etc.

Figure 6:
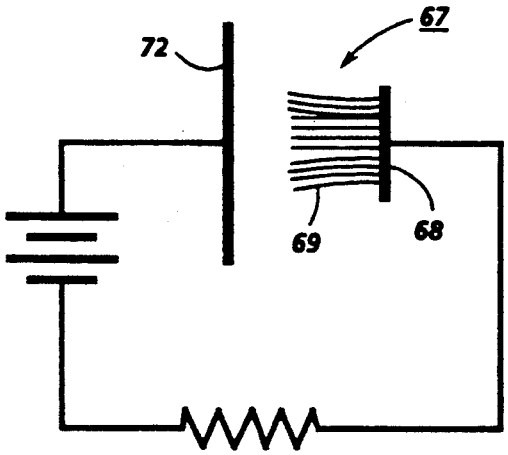
FIG. 6 is a representation of the circuit used in evaluating the electrical connection according to the present invention.

FIG. 6 represents schematically a test fixture wherein the electrical connection according to the present invention was evaluated. In the test fixture, the brush 67 was made of conductive steel fibers 25 micrometers in diameter held in a terminal 68 to provide a brush. One centimeter square and 4 millinches long which was held against a 4 centimeter square flat aluminum plate as the landing pad 72. The following tests were conducted with the following results achieved. The clean contact was closed and opened with a thousand volts applied during actuation, the current being limited to 1 milliampere upon closure. No failure in electrical contact was observed after 1,000,000 closures on each of two contacts on the same fixture electrically connected in series. In a subsequent test, toner was poured onto the brush fiber and the flat aluminum plate which was held at about 50° to the horizontal. The plate and brush were completely coated with the toner, two hundred volts at 1 milliampere was applied and no failures were experienced after 800,000 closures of the contacts. During the test additional toner was added to the fiber and aluminum plate about 5 times. The plate was not cleaned and toner remained on the pad throughout the test. Fuser oil was poured over the coated toner on the contacts so that both the brush and the plate were quite gooey. Two hunderd volts at 1 milliampere was applied and no failures were experienced after a 100,000 closures of the two contacts. During the test additional oil was poured over the contacts about 3 times and the contacts remained gooey throughout the test.

In addition, a 7,000 volt power supply was connected through the contact and current limited to 1 milliampere, with no difficulties experienced. The contact was not open with the power applied. During the testing, at various points the resistance of the contact was measured including with toner and oil. Typically, this was determined to be 30 to 50 ohms and never exceeded 100 ohms.

By providing an electrical contact between two movable members such as the main frame of a printing machine and a unit removable therefrom which comprises a very large continuous conductive contact surface for one contact element and a plurality of resiliently flexible conductive fibers for the second contact element an electrical contact of tremendously improved reliability is achieved. As a result of the very large number of individual fibers capable of making the electrical contact with the conductive contact surface or landing pad as well as providing a large potential contacting surface area in the landing pad a very high redundancy level of electrical contacts is provided. Furthermore, as a result of the very large number of potential electrical contacts even typical contaminats in printing machine environments such as toner and fuser oil do not result in contact failure. To the contrary, the present contact appears to be impervious to dirt, toner, oil and other contamination. Furthermore, as a result of the structure and relationship between the size of the contact surface area and the brush cross sectional area, electrical contact between the unit and the main frame may be maintained without the requirement for high tolerance in the precision alignment of the removable unit when it is inserted in the assembly. The present invention also has the advantage of being relatively inexpensive in that the conductive landing pad surface may end up being an etched pattern on a printed wiring board and be capable of automated assembly. Accordingly, the cost of the conductive contact surface is very, very low. The present invention also has an advantage over a potential brush-to-brush contact in that it does not require the position and alignment accuracy necessary for brush-to-brush contact and is much cheaper since only one of the more expensive brush contacts in the electrical interface is required.

The disclosures of the patents, applications and other references referred to herein are hereby specifically and totally incorporated herein by reference.

Figure 7A:
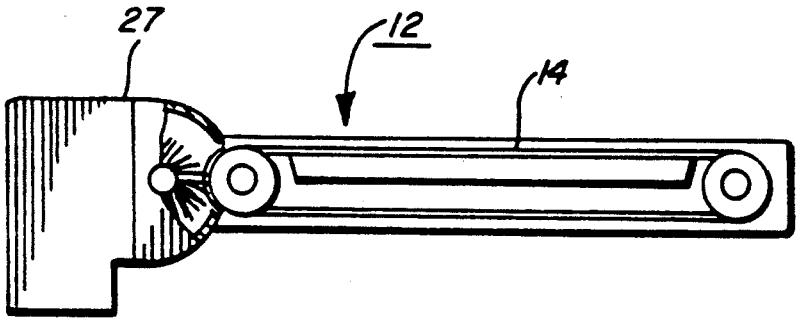
FIGS. 7A, B, and C are alternative representations of removable processing cartridges in electrostatographic printing machines.
Figure 7B:
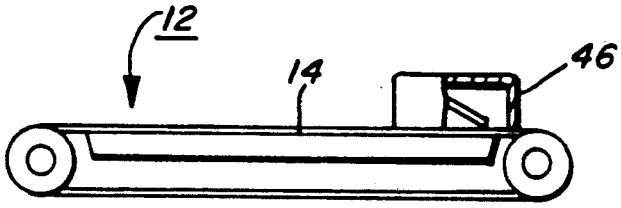
Figure 7C:
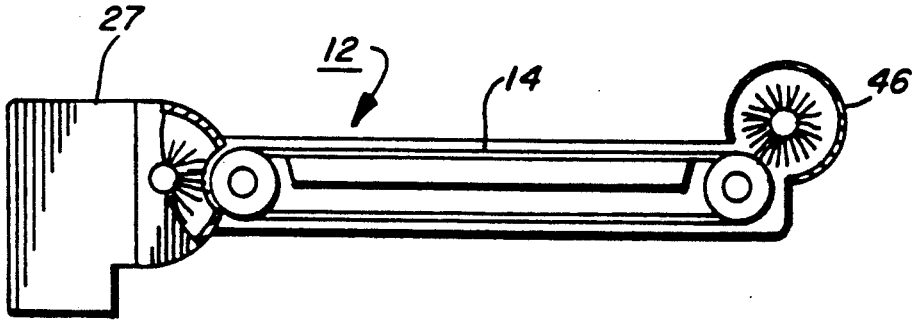

While the invention has been described with reference to specific embodiments, it will be apparent to those skilled in the art that many alternatives, modifications and variations may be made. For example, while the invention has been generally illustrated with reference to electrostatographic printing machine it will be understood that it has application in virtually any kind of machine which has a unit which is removable therefrom and which requires an electrical connection between the removable unit in the main frame. Furthermore, while the removable unit has been illustrated as comprising a photoreceptor and a precharge corotron, it will be understood that other processing units may form part of the removable unit. In this regard, attention is directed to FIGS. 7A, B and C wherein alternative embodiments are illustrated. In FIG. 7A, the removable unit includes in addition to the photoreceptor belt the developer housing. In FIG. 7B, the removable unit includes in addition to the photoreceptor belt cleaner housing and in FIG. 7C, the processing cartridge includes in addition to the photoreceptor belt both the developer housing and a cleaner housing. It will further be understood that there may be multiple such electrical connections on each unit and that multiple removable units; may be used for each machine. For example, there may be separate units containing the photoreceptor and the developer housing. Accordingly, it is intended to embrace all such alternatives and modifications as may fall within the spirit and scope of the appended claims.

We claim:

1. A machine for performing at least one function comprising a main frame and at least one unit insertable into and removable from said main frame for cooperative association therewith in producing, said at least one function, said main frame and said removable unit having at least one electrical connection to conduct electric current therebetween comprising two electrical contacting elements, one on each of said main frame and said removable unit, a first contacting element comprising a plurality of resiliently flexible conductive carbonized polyacrylonitride fibers arranged in a brush-like configuration and the second element comprising a substantially continuous conductive contact surface for electrical contact with said brush each of said contacting elements being connected to an electrical component.

2. The machine of claim 1 wherein the area of one of said contact elements is substantially greater than the cross-sectional area of the other of said contact elements.

3. The machine of claim 2 wherein the area of said contact surface is substantially greater than the cross sectional area of said brush.

4. The machine of claim 1 including a support holder for said fibers to support them such that they are oriented and extend in a uniform direction so that the distal ends of the fibers are in electrical contact with said contact surface.

5. The machine of claim 4 including a conductive adhesive to hold said fibers in said support holder.

6. The machine of claim 1 wherein said contact surface is planar.

7. The machine of claim 1 wherein said contact surface is a metal.

8. The machine of claim 1 wherein said fibers are stainless steel.

9. The machine of claim 1 wherein said fibers have a diameter of from about 5 micrometers to about 50 micrometers.

10. The machine of claim 9 wherein said fibers have a diameter of from about 7 to 10 micrometers.

11. The machine of claim 1 wherein said fibers have an electrical resistivity of from about $10^{-5}$ to about $10^{6}$ ohm-cm.

12. The machine of claim 11 wherein said fibers have an electrical resistivity of from about $10^{-5}$ to about $10^{-3}$ ohm cm.

13. The machine of claim 1 wherein said unit includes an imaging member and means to charge said imaging member.

14. The machine of claim 13 wherein said unit further includes a cleaner to remove residual toner from said imaging member.

15. The machine of claim 1 wherein said conductive contact surface is on a circuit board.

16. The machine of claim 1 wherein said brush contacting element is on said removable unit.

17. The machine of claim 1 wherein said brush contacting element is on said main frame.

18. The machine of claim 1 wherein said electrical connection is made in a direction parallel to the direction of insertion of said unit into said main frame.

19. The machine of claim 1 wherein said electrical connection is made in a direction perpendicular to the direction of insertion of said unit into said main frame.

20. The machine of claim 5 wherein said support holder is a terminal having a wire crimp feature which is crimped to the wire.

21. The machine of claim 1 wherein said contact surface is a conductive pattern on an insulator.

22. The machine of claim 1, wherein the fibers are present in said brush to provide from about $5\times10^{4}$ to about $2.5\times10^{5}$ contacts per square centimeter.

23. A machine for performing at least one function comprising a main frame and at least one unit insertable into and removable from said main frame for cooperative association therewith in producing said at least one function, said main frame and said removable unit having at least one electrical connection to conduct electric current therebetween comprising two electrical contacting elements, one on each of said main frame and said removable unit, a first contacting element comprisng a plurality of resiliently flexible conductive fibers arranged in a brush-like configuration and the second element comprising a substantially continuous conductive contact surface for electrical contact with said brush each of said contacting elements being connected to an electrical component, said contact surface comprising a pultruded composite member comprising a plurality of small diameter conductive fibers in a polymer matrix said plurality of fibers being oriented in said matrix in a direction substantially parallel to the axial direction of said member and being continuous from one end of said member to the other to provide a plurality of potential electrical contacts to each end of said member.

24. The machine of claim 23 wherein the area of one of said elements is substantially greater than the cross-sectional area of the other of said contact elements.

25. The machine of claim 23 including a support holder for said fibers to support them such that they are oriented and extend in a uniform direction so that the distal ends of the fibers are in electrical contact with said contact surface.

26. The machine of claim 25 including a conductive adhesive to hold said fibers in said support holder.

27. The machine of claim 24 wherein the area of said contact surface is substantially greater than the cross sectional area of said brush.

28. The machine of claim 23 wherein said contact surface is planar.

29. The machine of claim 23 wherein said contact surface is a metal.

30. The machine of claim 23 wherein said fibers are stainless steel.

31. The machine of claim 23 wherein said fibers are carbon fibers.

32. The machine of claim 23 wherein said carbon fibers are carbonized polyacrylonitrile fibers.

33. The machine of claim 23 wherein said fibers have a diameter of from about 5 mircrometers to about 50 micrometers.

34. The machine of claim 33 wherein said fibers have a diameter of from about 7 to 10 micrometers.

35. The machine of claim 23 wherein said fibers have a electrical resistivity of from about $10^{-5}$ to about $10^{6}$ ohm.

36. The machine of claim 35 wherein said fibers have an electrical resistivity of from about $10^{-5}$ to about $10^{-3}$ ohm-cm.

37. The machine of claim 23 wherein said brush contacting element is on said removable unit.

38. The machine of claim 23 wherein said brush contacting element is on said main frame.

39. The machine of claim 23 wherein said electrical connection in made is a direction parallel to the direction of insertion of said unit into said main frame.

40. The machine of claim 23 wherein said electrical connection is made in a direction perpendicular to the direction of insertion of said unit into said main frame.

41. The machine of claim 25 wherein said support holder is a terminal having a wire crimp feature which is crimped to the wire.

42. The machine of claim 23 wherein said contact surface is a conduction pattern on an insulator.

43. The machine of claim 23 where the fibers are present in said brush to provide from about $5\times10^{4}$ to about $2.5\times10^{5}$ contacts per square centimeter.

* * * * *